US007384217B1

(12) United States Patent
Barrett et al.

(10) Patent No.: US 7,384,217 B1
(45) Date of Patent: Jun. 10, 2008

(54) SYSTEM AND METHOD FOR SOIL STABILIZATION OF SLOPING SURFACE

(76) Inventors: Robert K. Barrett, 549 S. Broadway, Grand Junction, CO (US) 81503; Albert C. Ruckman, 3491 E. Road, Palisade, CO (US) 81526

( * ) Notice: Subject to any disclaimer, the term of this patent is extended or adjusted under 35 U.S.C. 154(b) by 0 days.

(21) Appl. No.: 11/693,586

(22) Filed: Mar. 29, 2007

(51) Int. Cl.
*E02D 17/20* (2006.01)

(52) U.S. Cl. ..... 405/302.7; 405/302.4; 405/15; 405/302.6

(58) Field of Classification Search ..... 405/302.6, 405/302.4, 302.7, 15
See application file for complete search history.

(56) References Cited

U.S. PATENT DOCUMENTS

| | | | | |
|---|---|---|---|---|
| 571,225 | A | 11/1896 | Geisel | |
| 1,597,573 | A | 8/1926 | Blue | |
| 3,060,694 | A | 10/1962 | Holmes | |
| 3,286,416 | A | 11/1966 | Ashworth | |
| 3,487,646 | A | 1/1970 | Gatien | |
| 3,496,729 | A | 2/1970 | Pleuger | |
| 3,808,624 | A | 5/1974 | Barkdull, Jr. | |
| 3,981,038 | A | 9/1976 | Vidal | |
| 4,181,995 | A | 1/1980 | Zur | |
| 4,345,856 | A * | 8/1982 | Tuck | 405/302.6 |
| 4,360,292 | A | 11/1982 | Keeler et al. | |
| 4,564,313 | A | 1/1986 | Niswander et al. | |
| 4,564,967 | A | 1/1986 | Vidal | |
| 4,571,124 | A | 2/1986 | Matsui et al. | |
| 4,610,568 | A | 9/1986 | Koerner | |
| 4,993,872 | A | 2/1991 | Lockwood | |
| 5,044,831 | A | 9/1991 | Myles et al. | |
| 5,310,288 | A * | 5/1994 | Huang | 405/302.6 |

(Continued)

FOREIGN PATENT DOCUMENTS

| | | |
|---|---|---|
| EP | 0307291 | 3/1989 |
| GB | 002289078 | 11/1995 |
| JP | 403257216 | 11/1991 |
| JP | 408189035 | 7/1996 |
| JP | 02004027813 | 1/2004 |

OTHER PUBLICATIONS

U.S. Appl. No. 11/693,584, Barrett.

(Continued)

*Primary Examiner*—Frederick L Lagman
(74) *Attorney, Agent, or Firm*—Sheridan Ross PC

(57) ABSTRACT

A system and method are provided for promoting vegetation growth on a steeply sloping surface. The system of the present invention includes anchors that are secured to the sloping surface, an inner mesh layer in contact with the slope, a geosynthetic layer placed over the inner mesh layer, and seeded compost material placed in the gap or space between the geosynthetic layer and the inner mesh layer. An outer mesh layer is placed over the geosynthetic layer to help stabilize the geosynthetic layer. The geosynthetic layer and outer mesh layer are also secured to the protruding anchors. Vegetation grows in the compost material and roots of the vegetation penetrate the inner mesh layer into the slope. An established root system stabilizes the slope. The seeded compost material provides an environment that greatly enhances the growth of vegetation on steeply sloping surface which otherwise do not have adequate soil to promote growth. The anchors provide additional structural stabilization for the slope and also provide a means to attach the layers of materials.

13 Claims, 5 Drawing Sheets

U.S. PATENT DOCUMENTS

| | | | | |
|---|---|---|---|---|
| 5,421,123 | A * | 6/1995 | Sakate et al. | 405/302.7 |
| 5,472,296 | A | 12/1995 | von Allmen et al. | |
| 5,494,378 | A | 2/1996 | Hanson | |
| 5,542,785 | A | 8/1996 | Cloud | |
| 5,549,418 | A | 8/1996 | Devine et al. | |
| 5,669,199 | A | 9/1997 | Ludwig et al. | |
| 5,713,162 | A | 2/1998 | Gallo et al. | |
| 5,713,701 | A | 2/1998 | Marshall | |
| 5,786,281 | A * | 7/1998 | Prunty et al. | 405/15 |
| 5,864,993 | A | 2/1999 | Wells | |
| 5,934,836 | A | 8/1999 | Rupiper et al. | |
| 6,280,120 | B1 | 8/2001 | Okamoto et al. | |
| 6,524,027 | B1 | 2/2003 | Fabius | |
| 6,533,498 | B1 | 3/2003 | Quin | |
| 6,652,195 | B2 | 11/2003 | Vickars et al. | |
| 6,745,421 | B2 | 6/2004 | Barrett et al. | |
| 6,776,242 | B1 | 8/2004 | Cunningham | |
| 6,820,379 | B1 | 11/2004 | Krinner et al. | |
| 6,890,127 | B1 | 5/2005 | Barrett et al. | |
| 6,926,186 | B2 | 8/2005 | Wells | |
| 6,929,425 | B1 * | 8/2005 | Kimberlin et al. | 405/302.4 |
| 7,025,016 | B1 | 4/2006 | Landes | |
| 2004/0031214 | A1 | 2/2004 | Fong et al. | |
| 2004/0202512 | A1 | 10/2004 | Smith | |
| 2005/0135882 | A1 | 6/2005 | Barrett | |
| 2006/0263150 | A1 | 11/2006 | Barrett | |

OTHER PUBLICATIONS

Poly(Vinyl Chloride) Copyright 1995, 1996; http://www.psrc.usm.edu/macrog/pvc.htm; 3 pages.

Colorado Department of Transportation Bridge Design Manual Section Seven, Substructures (Sections 7.1-7.3); Nov. 2, 1987, 11 Pages.

Colorado DOT Demonstration "The Soil Nail Launcher, Where Speed, Cost and the Environment are Important" www.soilnail-launcher.com; 1 page.

"Enkamat Root Reinforcement Matrix $R^2M$", Colbond Inc., date unknown, 4 pages.

"Enkamat Permanent Erosion Prevention Mat", Colbond Inc., date unknown, 16 pages.

"Geosynthetics", Colbond Inc., date unknown, 6 pages.

"Enkamat Enkamat", Colbond bv, available at http://www.colbond-geosynthetics.com/cms/generated/pages/products/enkamat/productfamily/1%C2%A7Enkamat.html, 2004, 2 pages.

"Enkamat Uses", Colbond bv, available at http://www.colbond-geosynthetics.com/cms/generated/pages/products/enkamat/uses/, 2004, 2 pages.

"Enkamat Why Enkamat?", Colbond bv, available at http://www.colbond-geosynthetics.com/cms/generated/pages/products/enkamat/whyenkamat/, 2004, 2 pages.

"Transportation/Geotechnical Soil Reinforcement", Colbond bv, available at http://www.colbond-geosynthetics.com/cms/generated/pages/applications/transportation/soilreinforcement/default.htm, 2004, 2 pages.

"Dry Slopes Erosion Control", Colbond bv, available at http://www.colbond-geosynthetics.com/cms/generated/pages/applications/dryslopes/erosioncontrol/default.htm, 2004, 2 pages.

"Wet Slopes Erosion Control", Colbond bv, availabel at http://www.colbond-geosynthetics.com/cms/generated/pages/applications/wetslopes/erosioncontrol/default.htm, 2004, 2 pages.

"Functions Erosion Control", Colbond bv, available at http://www.colbond-geosynthetics.com/cms/generated/pages/functions/erosioncontrol/default.htm, 2004, 2 pages.

"Enkamat filled with a bitumen-bound mineral filter", Colbon Geosynthetics PartnerNews Aug. 1999, p. 6-8.

* cited by examiner

SYSTEM AND METHOD FOR SOIL STABILIZATION OF SLOPING SURFACE

FIELD OF THE INVENTION

The present invention relates to systems and methods for restoring natural vegetation to sloping surfaces such as those created in the construction of roads and bridges, and more particularly, to systems and methods of restoring natural vegetation to steep slopes that do not have adequate soil to grow vegetation.

BACKGROUND OF THE INVENTION

In the construction of various manmade projects such as roads and bridges, it is often necessary for the terrain around the project to be altered to accommodate a designed route. In hilly or mountainous terrain, traditional techniques for creating the route include earth moving and blasting efforts that can create very steep and unstable slopes. In the case of steep slopes that are cut from terrain with rock formations, the complete lack of soil can make it quite difficult for any vegetation to grow on the sloping surface such that significant soil erosion and the possibility of catastrophic collapse of the sloping surface is always a threat.

There a number of construction methods that have been employed to reduce soil erosion as well as to prevent catastrophic collapse of such sloping surfaces. For example, one method for preventing catastrophic collapse of a sloping surface is to create terraces on the sloping surface. Other techniques for preventing at least erosion of soil include the use of a geotextile mat anchored on the sloping surface.

One problem associated with efforts to stabilize a sloping surface is the cost associated with those efforts. Particularly for large cuts made in rocky terrain, extensive effort is required to properly terrace the slope. Additionally, geotextile material installed to prevent soil erosion further adds to the costs of the project.

Various state and national road construction standards require that sloping surfaces have a designated offset from the road to minimize the hazard of material sliding or falling onto the road. The standards also require stabilizing rock formations in the slope that could present a hazard to road users of the formation became unstable thereby allowing large rocks to fall. Even with these safety standards, soil erosion or more catastrophic soil and rock failures may be continual problems since it may take many years or even decades for adequate vegetation to grow on the sloping surface to stabilize the soil and rock.

Therefore, there is a need to provide a cost-effective, reliable, yet simple system and method for restoring natural vegetation to steep sloping surfaces.

In addition to preventing soil erosion, restoring natural vegetation to a sloping surface has environmental benefits such as the filtering of pollutants, recharging ground water, improving water quality, and restoring native ecosystems. The trend in both federal and state environmental quality standards increasingly requires that construction projects create minimal damage to the surrounding environment. Thus, an environmentally solution is also preferred with respect to stabilizing the sloping surfaces to meet these environmental standards.

With respect to using geotextile material to prevent soil erosion, geotextile material alone is ineffective on steep sloping surfaces, and particularly those steep sloping surfaces with rock formations. The geotextile material may fail in landslides or extreme erosion conditions since it has a limited material strength and is difficult to anchor to the slope. The geotextile material alone has little capability to stabilize the underlying geologic formation. Also, since use of geotextile material does not compensate for the lack of soil to adequately grow vegetation, even where geotextile material can be used, soil must be still present to grow the vegetation.

SUMMARY OF THE INVENTION

In accordance with the present invention, a system and method are provided for promoting vegetation growth on steep sloping surfaces. The system and method of the present invention include a plurality of anchors that are installed on the slope to provide a structurally stable slope, and to provide a means to attach layered geotextile/geosynthetic materials to the slope. The anchors may include soil nails that are secured to the sloping surface as by a pneumatic launching device. The anchors may also be secured to the slope by drilling holes in the side of the slope, and then inserting the anchors in the bore holes along with cementous material.

A first or inner mesh layer is placed on the sloping surface and the mesh layer is secured to the plurality of anchors. This first or inner mesh layer is preferably a steel mesh configuration, similar to chain link fencing. The inner mesh layer provides some additional structural stability to the sloping surface to prevent dislodgement of rocks or other debris which might otherwise occur by the force of erosion. A geosynthetic layer is then secured to the slope over the inner mesh layer. The lower or bottom edge of the inner geosynthetic layer is folded under and against the slope to form a u-shaped pocket. This lower edge is pinned or otherwise attached to the mesh layer and/or to the slope itself to adequately secure the geosynthetic layer. An outer mesh layer is placed over the geosynthetic layer to further stabilize the sloping surface, and to provide overlying support to the geosynthetic layer. Alternatively, the outer mesh layer and the geosynthetic layer may be secured to one another as a unit, and once the inner-mesh layer is placed on the slope, then the outer mesh layer and geosynthetic layer are secured simultaneously over the inner-mesh layer. The geosynthetic layer and outer mesh layer are also secured to the slope by attaching these layers to the protruding plurality of anchors.

After the mesh layers and geosynthetic layer are installed, composted organic material is installed between the layers of mesh and specifically in the gap or pocket that resides between the interior surface of the geosynthetic layer and the inner-mesh layer. This composted organic material also has a selected seed mix.

Depending upon the size and orientation of the sloping surface, the outer mesh layer and geosynthetic layer may be installed in groups of horizontally oriented and vertically stacked groups referred to herein as panels. Each panel is sequentially placed along the sloping surface until all or a desired portion of the slope is covered. Adjacent edges of the panels are secured to one another in order to provide a system of interlocking panels. Accordingly, the system of the present invention can be defined as including a plurality of joined individual panels, while a device of the present invention can be defined as simply including a single panel secured to the sloping surface.

Over time, the seed mix placed within the composted organic material develops into natural vegetation that grows inside the composted material. As time progresses, the roots of the vegetation begin to penetrate through the inner mesh layer and into the sloping surface. A strong root system ultimately develops as the vegetation grows. The root system ultimately stabilizes the slope. The anchors provide additional structural stability to the slope, and until a root system is established, the anchors provide the primary structural stability for the slope. The layered mesh materials provide a means to maintain a significant amount of organic material on the sloping surface thereby promoting growth of vegetation. Once the natural vegetation is established on the slope, concerns over soil erosion or catastrophic collapse of the sloping surface are greatly reduced.

These and other features and advantages of the present invention will become apparent from a review of the following detailed description, taken in conjunction with the drawings.

BRIEF DESCRIPTION OF THE DRAWINGS

FIG. 3 also illustrates the composted organic material placed in the pocket or gap between the inner mesh layer and the geosynthetic layer;

DETAILED DESCRIPTION

Figure 1:
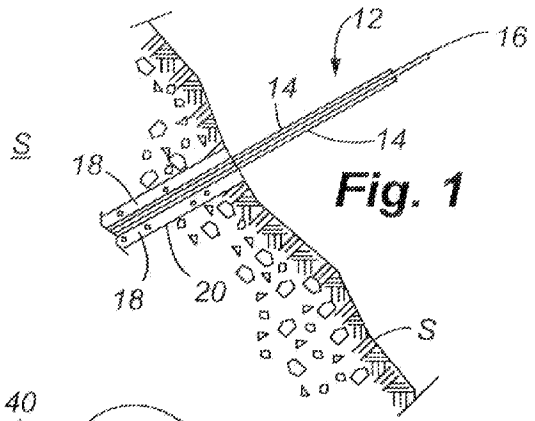
FIG. 1 is a cross-sectional view of one example of an anchor that may be employed in the system and method of the present invention.

FIGS. 1-4 show the basic steps in installing the device and system of the present invention. Beginning first with FIG. 1, a plurality of anchors 12 are installed on the sloping surface. The type of anchor chosen for installation can depend upon the particular nature of the sloping surface to include the soil/rock formation, the size of the slope, and the particular size and orientation of the system to be installed. The particular anchor illustrated in FIG. 1 includes an inner core or rod 16, and outer protective sleeve 14. A bore hole 20 having grout/cementous material 18 placed therein stabilizes the anchor 12 in the bore hole. Other types of anchors that can be used may include soil nails that have reinforcing rods inserted into the face of the slope by a launching device. One example of a soil nail that may be used as well as the method of emplacement is disclosed in U.S. Pat. No. 5,044,831, this patent being hereby incorporated by reference. This patent discloses a method of soil nailing wherein a soil nail is placed into the ground by being fired from a barrel of a launcher. The soil nail is loaded into the barrel, and pressurized gas emitted from the barrel forces the soil nail into the ground to a desired depth. With respect to soil nailing by use of a launcher that is mounted to a vehicle, one example of such a device is disclosed at www.soilnaillauncher.com, and such a device is referred to as the "Green Machine."

Other types of anchors that can be used may include any type of reinforcing rods inserted in the face of the slope made of steel, fiberglass, aluminum, or combinations thereof. The reinforcing rods may be smooth, deformed, hollow, or combinations thereof.

Figure 2:
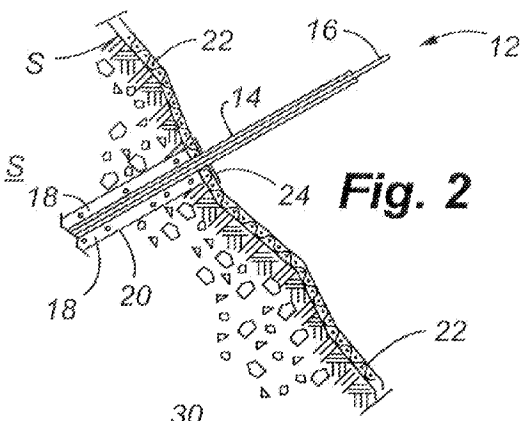
FIG. 2 is another cross-sectional view of the anchor installed in the sloping surface, along with the inner mesh layer secured to the sloping surface by the anchor.

Referring to FIG, 2, once the anchors 12 are installed, then the inner or interior mesh layer 22 is secured to the slope. The anchors 12 protrude through openings in the mesh layer 22, and the mesh layer 22 is then secured to the protruding portions of the anchors 12. One method to secure the mesh layer 22 to the anchors is by use of plates or connectors that hold the mesh layer 22 in contact with the sloping surface. In the example of FIG. 2, a plate 24 may have a central opening, and the plate 24 is then slipped over the protruding portion of the anchor. The plate may then be welded to the anchor, or the anchor 12 and plate 24 may be threaded with one another.

Figure 6:
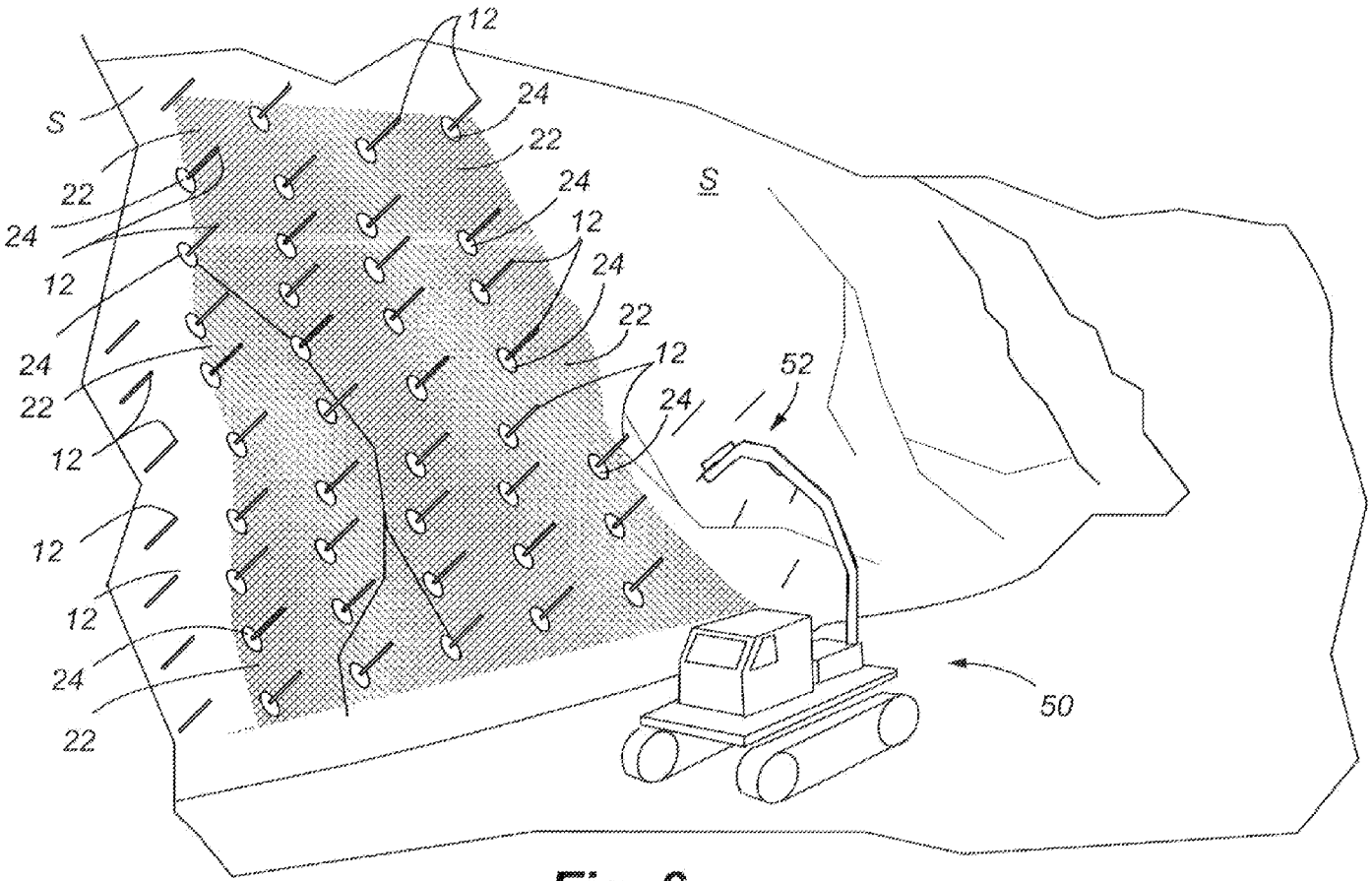
FIG. 6 is a perspective view illustrating anchors placed in a sloping surface as well as the inner mesh layer secured to the sloping surface.

Also referring to FIG. 6, a slope S is shown with a plurality of anchors 12 being in place, along with a section of the inner mesh layer 22 secured to the sloping surface by the plates 24. Depending upon the size of the slope to be covered, as well as the particular type of inner mesh layer used, the inner mesh layer 22 may be installed in smaller or larger sections that traverse the slope. As also shown in FIG. 6, a vehicle 50 including a soil nail launching apparatus 52 is being used to place the anchors 12. The vehicle 50 being used in this example resembles the "Green Machine" disclosed at the soil rail launches website. The anchors can be substantially uniformly spaced vertically and horizontally from one another on the slope in a geometric pattern as shown; however, more or less anchors may need to be placed at certain locations on the slope depending upon the rock and soil content of the slope at those locations.

Referring back to FIGS. 3 and 4, the next steps in installation of the system includes securing the geosynthetic layer 30 and the outer mesh layer 34 respectively. These steps are shown as separate sequential steps; however, the geosynthetic layer 30 and the outer mesh layer 34 may be provided as a unit wherein the geosynthetic layer is previously secured to the outer mesh layer. The geosynthetic layer may be secured to the outer mesh such as by wire ties or other hardware, depending upon the type of geosynthetic layer and outer mesh layer chosen. Preferably, the outer mesh layer is made of the same material as the inner mesh layer. The geosynthetic layer is preferably one that promotes the growth of natural vegetation wherein the vegetation grows through the gaps integrally formed in the geosynthetic layer. One example of an acceptable type of geosynthetic material that may be used are various geosynthetic products provided by Enkamat®. Enkamat® is a dense three-dimensional permanent erosion prevention mat, made of thick polyamide filaments fused in a crossing pattern. A great majority of the volume of this type of mat is available for soil filling that ensures positive integration and stabilization of sloping surfaces, while providing an environment for seed germination. Once vegetation is established, this type of geosynthetic layer also provides the root system of the vegetation with permanent reinforcement. As shown, the compost material 40 is placed between the geosynthetic layer and the inner mesh layer. One method of filling the gap is by a delivery tube 42 that delivers the composted material by pneumatic pressure. It should also be understood that the compost material may include both organic and inorganic material to best promote the type of vegetation selected. Inorganic material may include certain types of fertilizer or other chemicals to promote the vegetation growth.

Figure 4:
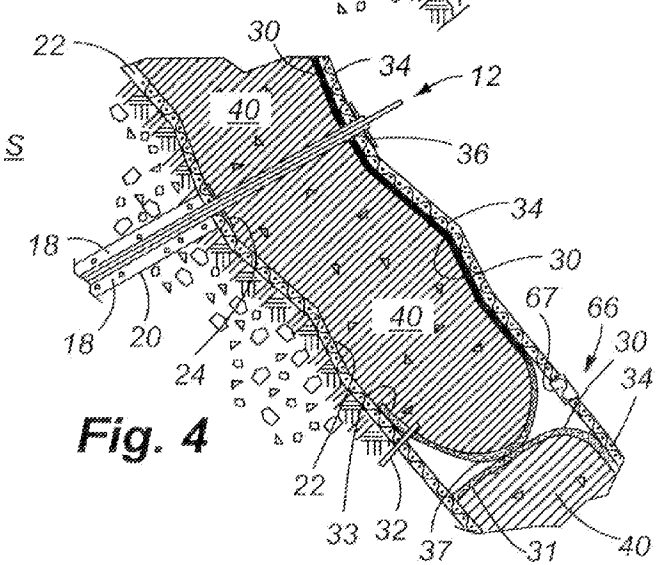
FIG. 4 is another cross-sectional view illustrating the outer mesh layer secured to the anchor and the geosynthetic layer.

As also shown in FIG. 4, the lower edge or end 33 of the geosynthetic layer is folded against the inner mesh layer thus forming a U-shaped pocket 37. One or more pins or connectors 32 are used to maintain the geosynthetic layer and outer mesh layer in this arrangement. As also illustrated in FIG. 4, the free upper edge 31 of the geosynthetic layer may be secured to the inner mesh layer when the filling of compost is complete for that particular panel. An appropriate wire tie or other hardware (not shown) can be used to secure the upper edge 31.

An outer connecting plate 36 may be used to secure the outer mesh layer 34 and geosynthetic layer 30 to the protruding anchor, as shown. The outer plate 36 may be of the same configuration and constructions as the inner plate 24. Thus, the outer plate 36 may be welded to the anchor or the outer plate and anchor may be threaded.

Figure 3:
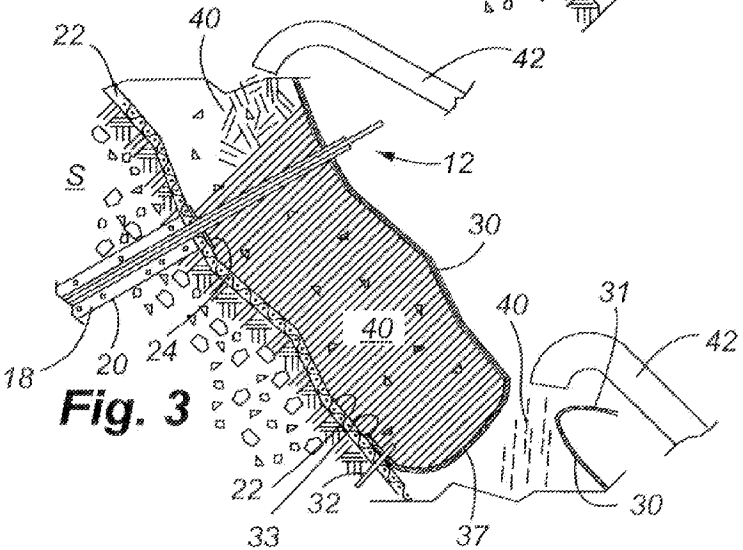
FIG. 3 is another cross-sectional view of the anchor, along with the inner mesh layer as well as the geosynthetic layer secured to the inner mesh layer and the anchor.

FIGS. 3 and 4 show two adjacent panels being filled with the compost material, thus the horizontally extending seam 66 between the adjacent panels is created. Preferably, adjacent panels are connected to one another to better stabilize the system as a whole and to prevent the geosynthetic material from becoming directly exposed. Accordingly, wire ties or other connectors may be used to secure the abutting ends of the outer mesh layers. In FIG. 4, a connector 67 is used to connect the abutting outer mesh layers 34 of the respective panels.

Figure 5:
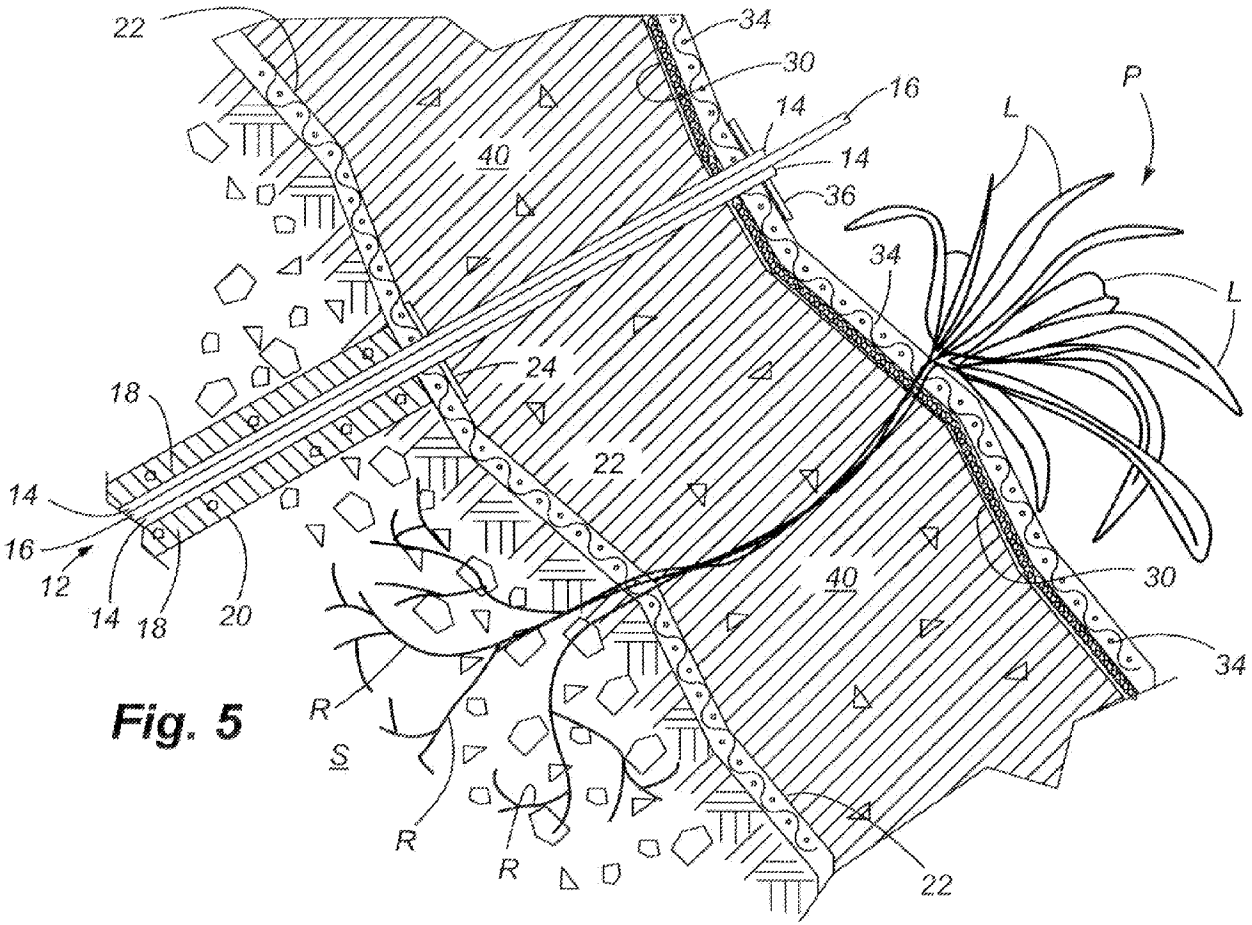
FIG. 5 is a greatly enlarged cross-sectional view illustrating the device of the present invention wherein some vegetation has grown with roots penetrating testing surface.

FIG. 5 is an enlarged fragmentary cross-sectional view illustrating a device of the present invention installed on the sloping surface S. As discussed previously with respect to FIGS. 1-4, the protruding anchor 12 allows the inner, outer, and geosynthetic layers to be adequately secured to the slope, and the compost material fills the gap between the geosynthetic layer and inner mesh layer. Vegetation is then allowed to grow out through the geosynthetic layer and outer mesh layer. The roots of the vegetation ultimately penetrate the inner mesh layer and the slope. In FIG. 5, vegetation in the form of a plant P is illustrated wherein the plant has roots R that initially grow within the compost material, and then the roots penetrate the inner mesh layer and into the slope. The leafy portion L of the plant grows through the geosynthetic layer and the outer mesh layer.

Figure 7:
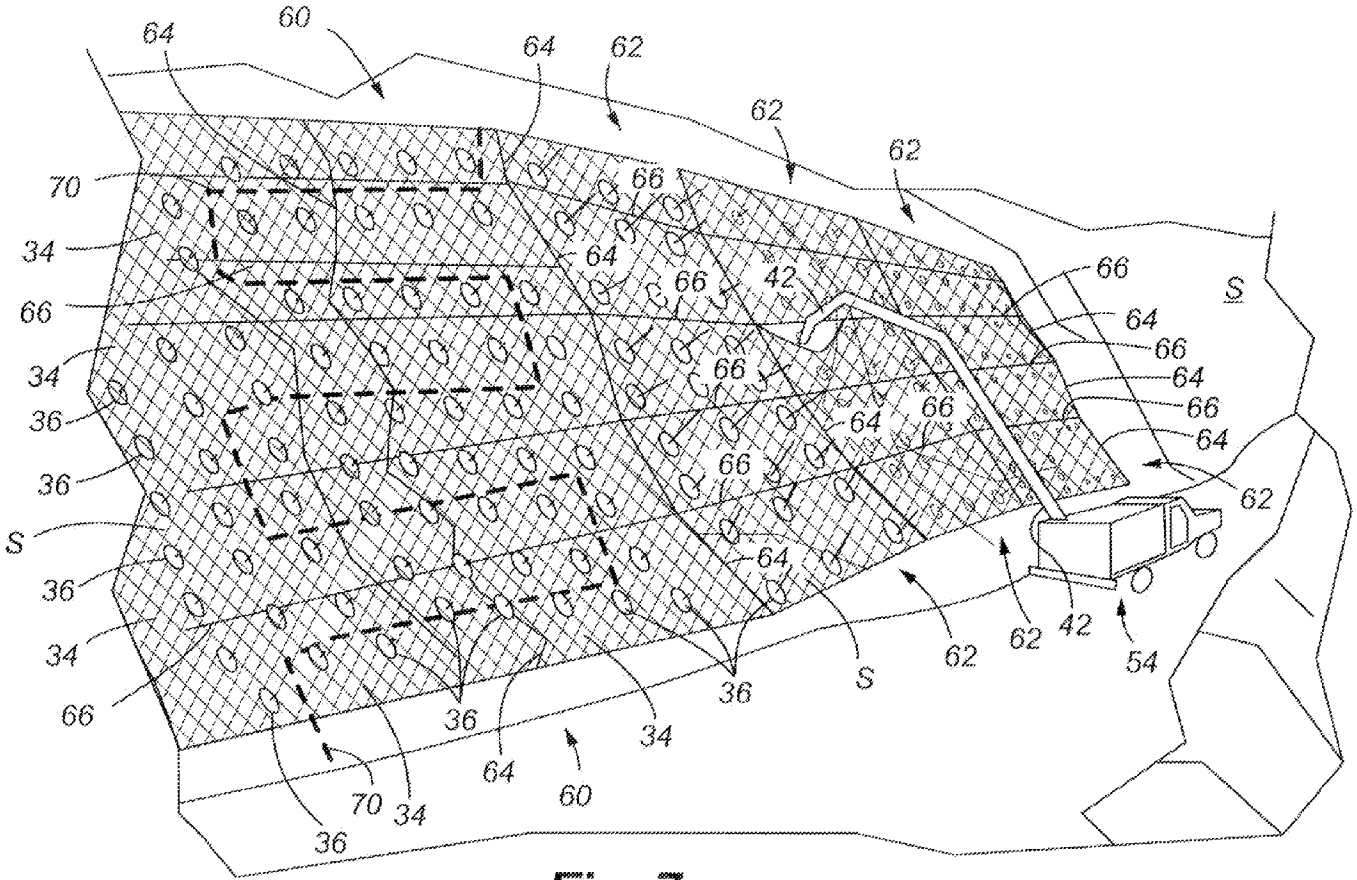
FIG. 7 is another perspective view illustrating the sloping surface wherein one portion of the system on the slope is completely installed, while other portions of the system are being progressively installed.

FIG. 7 shows the system of the present invention under construction. Installation on one section or portion 60 of the slope is complete, while installation of the system is still in progress on another section or portion 62 of the slope. The completed section 60 illustrates the outer mesh layer 34 being exposed. The rectangular shaped panels are separated by respective horizontal seams 66 and vertical seams 64. As mentioned above, these seams may be secured to one another as by wire ties or other connectors. The compost material is progressively filled in the individual panels, and the respective vertical and horizontal seams are then secured to one another. The anchors typically extend substantially perpendicular to the slope. The inner mesh layer, geosynthetic layer, and outer mesh layer cover the slope and therefore can be considered to extend substantially parallel with the slope.

As also shown in FIG. 7, the completed section 60 also has an external irrigation line 70 that traverses the slope. In order to further promote vegetation growth, the irrigation line may be provided. Preferably, the irrigation line is secured over the exposed surface of the outer mesh layer. The irrigation line 70 may be part of an irrigation system wherein automatic timed irrigation takes place or alternatively, manual irrigation may be conducted by selectively supplying water to the line. Multiple irrigation lines may be used on a slope depending upon its size and shape.

FIG. 7 also shows the progressive construction of the system wherein the compost vehicle 54 pneumatically conveys the compost material to each one of the panels. The vehicle 54 may have a pneumatic conveying system whereby the compost material is delivered under pneumatic pressure through the tube 42. The size and configuration of the system may dictate the best order in which to fill the respective panels with the compost material. In the example of FIG. 7, it may be most efficient to progressively fill a group of horizontally extending panels, and then progressively filling the higher level panels until each of the panels is filled. For the most upper or highest panels, it may be easier to move the vehicle 54 to the top of the sloping surface such that the conveying tube 42 extends down into the respective panels. The section 62 being constructed is shown as having the same general configuration as the completed section, more specifically, the incomplete section 62 has a plurality of rectangular shaped panels that are progressively placed on the sloping surface in somewhat of a geometric pattern.

Figure 8:
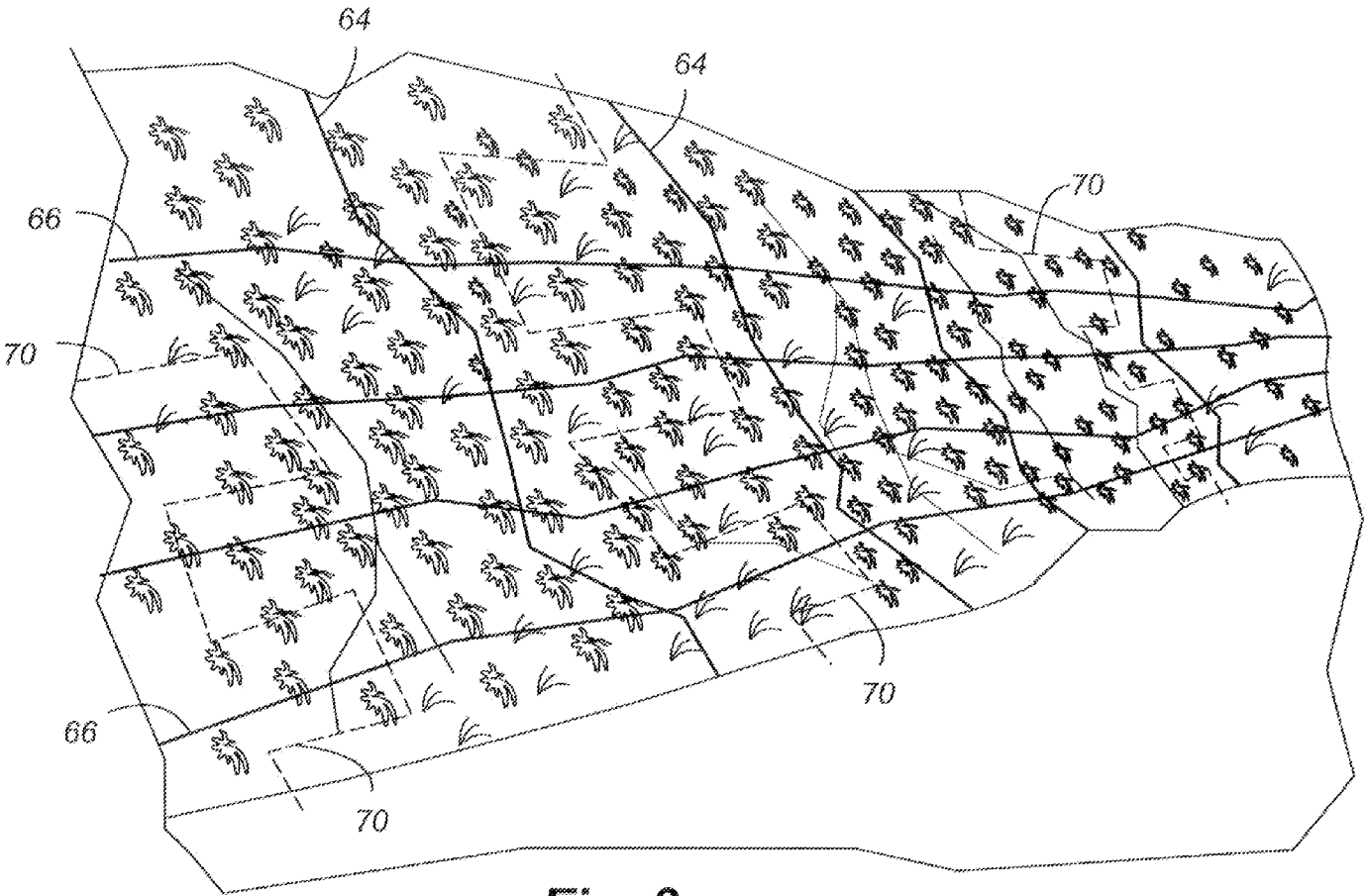
FIG. 8 is a perspective view illustrating the completed system installed on the slope and wherein vegetation has begun to grow on the sloping surface.

FIG. 8 illustrates the completed system wherein vegetation has begun to grow on the slope. Over time, increased growth of vegetation will occur and depending upon the particular seed mix provided, the growth of vegetation can be tailored for a specific application. In one example of the present invention, the panels may be formed in 12-foot widths and six to ten feet in height. The depth of the compost may be approximately six inches, which provides an adequate growth medium for many types of vegetation.

With the method of the present invention, the sequential process illustrated in FIGS. 1-4 result in the creation of a system to establish and maintain vegetation on a very steep sloping surface. In accordance with the method, various techniques may be employed for interconnecting adjacent panels, as well as the particular order in which the panels are filled with the compost material.

There are a number of advantages to the present invention. A device, system and method are provided for creating a stable growth medium on a very steep sloping surface which otherwise would not be capable of supporting plant growth. The anchors provide a structurally stable slope to prevent more catastrophic events such as a landslide or loss of large rocks along the slope. The anchors also provide a means to attach the various layers of the system. The addition of the compost material between the layers greatly enhances the growth of vegetation, and enables the roots of the plants to grow into the slope.

The device, system and method of the present invention have been illustrated with respect to one or more preferred embodiments; however, it shall be understood that various other changes and modifications may be made to the present invention that fall within the scope of the present invention in accordance with the scope of the claims appended hereto.

What is claimed is:

1. A device for promoting growth of vegetation on a slope, said device comprising:

a plurality of anchors secured in the slope;

an inner mesh layer placed against the slope and secured to the anchor;

a geosynthetic layer placed over the inner mesh layer and secured to said inner mesh layer and said anchors;

a seeded compost placed in a gap between the inner mesh layer and geosynthetic layer;

an outer mesh layer placed over the geosynthetic layer and secured to said geosynthetic layer and said anchors; and said geosynthetic layer has a lower end folded in contact against the inner mesh layer and in contact with the slope; and a plurality of connectors are provided for connecting the lower folded end of the geosynthetic layer to the inner mesh layer.

2. A device, as claimed in claim 1, wherein:

said plurality of anchors include a plurality of soil nails.

3. A device, as claimed in claim 1, wherein:

said plurality of anchors include a plurality of soil nails, each said soil nail including an inner core and an outer sleeve.

4. A device, as claimed in claim 1, wherein:

said anchors further include cementous material placed in boreholes that receive the anchors.

5. A device, as claimed in claim 1, further including:

an inner plate secured to at least one of said anchors, and said inner plate contacting said inner mesh layer for securing said inner mesh layer against the slope.

6. A device, as claimed in claim 1, further including:

at least one outer plate secured to said plurality of anchors, said outer plate being secured over said outer mesh layer to secure the outer mesh layer to the anchor.

7. A device, as claimed in claim 1, wherein:

said seeded compost material includes organic and inorganic material to promote growth of vegetation from seeds in the compost.

8. A device, as claimed in claim 1, wherein:

said anchors extend substantially perpendicular to the slope, and said inner mesh layer, said geosynthetic layer, and said outer mesh layer extend substantially parallel with the slope.

9. A device, as claimed in claim 1, wherein:

said anchors are substantially uniformly spaced vertically and horizontally from one another on the slope in a geometric pattern.

10. A device, as claimed in claim 1, wherein:

a plurality of devices are provided forming a system comprising a plurality of panels formed by separate pieces of said geosynthetic layer and said outer mesh layer, and wherein seams between said panels are connected to one another.

11. A system for promoting growth of vegetation on a slope, comprising:

a plurality of growth promoting devices placed on said slope, said devices being placed in abutting relationship with one another along vertical and horizontal seams, said plurality of devices being connected to one another along said seams, each said device including:

at least one anchor secured to the slope;

an inner mesh layer placed against the slope and secured by said at least one anchor;

a geosynthetic layer placed over the inner mesh layer;

seeded compost placed in a gap between said inner mesh layer and said geosynthetic layer; and an outer mesh layer secured over said geosynthetic layer and secured to said at least one anchor; wherein said geosynthetic layer has a lower end folded in contact against the inner mesh layer and in contact with the slope.

12. A method of installing a system for promoting growth of vegetation on a sloping surface, said method comprising the steps of:

installing a plurality of anchors on the sloping surface;

placing an inner mesh layer over the sloping surface and secured to said sloping surface by said anchors;

placing a geosynthetic layer and an outer mesh layer, over said inner mesh layer;

filling a gap between the inner mesh layer and geosynthetic layer with a seeded compost material; and wherein said outer mesh layer is secured to said plurality of anchors and wherein said filling step occurs after the placing steps whereby the gap may be selectively filled with the seeded compost material.

13. A method, as claimed in claim 12, further including the step of:

growing plants from seeds in said seeded compost, wherein roots of the plants penetrate the inner mesh layer and contact the slope, and when the plants protrude through the geosynthetic layer and the outer mesh layer.

* * * * *